US006802262B1

(12) United States Patent
Warnagiris et al.

(10) Patent No.: US 6,802,262 B1
(45) Date of Patent: Oct. 12, 2004

(54) TETHERLESS NEUROMUSCULAR DISRUPTER GUN WITH LIQUID-BASED CAPACITOR (LIQUID DIELECTRIC)

(75) Inventors: Thomas J. Warnagiris, San Antonio, TX (US); Drew L. Goodlin, Devine, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 10/695,284

(22) Filed: Oct. 28, 2003

Related U.S. Application Data

(62) Division of application No. 09/990,685, filed on Nov. 21, 2001, now Pat. No. 6,679,180.

(51) Int. Cl.[7] ..... F42B 12/02

(52) U.S. Cl. ..... 102/502; 102/293; 89/1.11; 361/232; 452/58; 463/47.3; 42/1.08

(58) Field of Search ..... 102/502, 293; 361/232; 89/1.11, 1.1; 42/1.08; 452/58; 463/47.3; 119/908, 174

(56) References Cited

U.S. PATENT DOCUMENTS

| | | | | | |
|---|---|---|---|---|---|
| 3,523,538 | A | | 8/1970 | Shimizu | 128/404 |
| 3,626,626 | A | | 12/1971 | Blanc | 43/6 |
| 3,771,249 | A | * | 11/1973 | Johnson et al. | 43/6 |
| 3,803,463 | A | * | 4/1974 | Cover | 361/232 |
| 3,971,292 | A | | 7/1976 | Paniagua | 89/1 |
| 4,253,132 | A | * | 2/1981 | Cover | 361/232 |
| 4,846,044 | A | | 7/1989 | Lahr | 89/1.11 |
| 4,852,454 | A | * | 8/1989 | Batchelder | 89/1.11 |
| 4,930,392 | A | | 6/1990 | Wilson | 89/1.11 |
| 5,103,366 | A | | 4/1992 | Battochi | 361/232 |
| 5,192,827 | A | | 3/1993 | Jasper, Jr. | 89/1.11 |
| 5,355,765 | A | | 10/1994 | Rogers | 89/14.4 |
| 5,473,501 | A | | 12/1995 | Claypool | 361/232 |
| 5,625,525 | A | | 4/1997 | Coakley et al. | 361/232 |
| 5,654,867 | A | | 8/1997 | Murray | 361/232 |
| 5,675,103 | A | | 10/1997 | Herr | 89/1.11 |
| 5,698,815 | A | | 12/1997 | Ragner | 102/502 |
| 5,750,918 | A | | 5/1998 | Mangolds et al. | 102/502 |
| 5,786,546 | A | | 7/1998 | Simson | 102/438 |
| 5,831,199 | A | | 11/1998 | McNulty, Jr. et al. | 89/1.11 |
| 5,936,183 | A | | 8/1999 | McNulty, Sr. | 89/1.11 |
| 5,952,600 | A | | 9/1999 | Herr | 89/1.11 |
| 5,962,806 | A | | 10/1999 | Coakley et al. | 102/502 |
| 6,636,412 | B2 | * | 10/2003 | Smith | 361/232 |

OTHER PUBLICATIONS

U.S. Pending patent application Ser. No. 10/695,003 entitled "Tetherless Neuromuscular Disrupter Gun with Liquid–Based Capacitor (Spray Discharge)" filed by Warnagiris et al and assigned to Southwest Research Institute, Oct. 28, 2003.

* cited by examiner

*Primary Examiner*—Jack W. Keith
*Assistant Examiner*—James S. Bergin
(74) *Attorney, Agent, or Firm*—Baker Botts L.L.P.

(57) ABSTRACT

A neuromuscular disrupter gun and associated projectile. The projectile contains a capacitor, having its dielectric made from liquid. The gun charges the projectile prior to discharge from the gun of the projectile. The projectile holds the charge in flight and discharges on impact. To provide appropriate contact points, the projectile either carries contact wires or is designed to open and emit the liquid upon impact.

32 Claims, 2 Drawing Sheets

TETHERLESS NEUROMUSCULAR DISRUPTER GUN WITH LIQUID-BASED CAPACITOR (LIQUID DIELECTRIC)

RELATED PATENT APPLICATION

This application is a divisional of U.S. patent application Ser. No. 09/990,685, filed Nov. 21, 2001 now U.S. Pat. No. 6,679,180, and entitled "Tetherless Neuromuscular Disrupter Gun with Liquid-Based Capacitor Projectile."

TECHNICAL FIELD OF THE INVENTION

This invention relates to non-lethal weapons, i.e., stun guns, and more particularly to a non-lethal neuromuscular disrupter that uses an untethered liquid projectile.

BACKGROUND OF THE INVENTION

Non-lethal neuromuscular disrupter weapons, sometimes referred to as "stun guns", use a handpiece to deliver a high voltage charge to a human or animal target. The high voltage causes the target's muscles to contract uncontrollably, thereby disabling the target without causing permanent physical damage.

The most well known type of stun gun is known as the TASER gun. TASER guns look like pistols but use compressed air to fire two darts from a handpiece. The darts trail conductive wires back to the handpiece. When the darts strike their human or animal target, a high voltage charge is carried down the wire. A typical discharge is a pulsed discharge at 0.3 joules per pulse. Taser guns and other guns of that type (herein referred to as neuromuscular disrupter guns or NDGs) are useful in situations when a firearm is inappropriate. However, a shortcoming of conventional NDGs is the need for physical connection between the target and the source of electrical power, i.e., the handpiece. This requirement limits the range of the NDG to 20 feet or so.

One approach to eliminating the physical connection is to use an ionized air path to the target. For example, it might be possible to ionize the air between the handpiece and the target by using high powered bursts or other air-ionizing techniques. However, this approach unduly complicates an otherwise simple weapon. An example of a NDG that uses conductive air paths to deliver a charge to the target is described in U.S. Pat. No. 5,675,103, entitled "Non-Lethal Tenanizing Weapon", to Herr.

Another approach to providing a wireless NDG is described in U.S. Pat. No. 5,962,806, entitled "Non-Lethal Projectile for Delivering an Electric Shock to a Living Target", to Coakley, et al. The electrical charge is generated within the projectile by means of a battery powered converter within the projectile.

SUMMARY OF THE INVENTION

One aspect of the invention is a projectile for use with a neuromuscular disrupter gun for delivery of an electrical charge to a target. The projectile has an outer housing suitable for containing liquid. A capacitor is contained within the housing, with the dielectric being made from a liquid material. Contacts are used to charge the capacitor, with the charge being delivered from a charging circuit in the gun. The capacitor may be charged prior to firing of the gun and it will discharge upon impact, either by means of contact wires that travel with the projectile or by releasing conductive liquid.

An advantage of the invention is that it combines existing ballistic technology with new materials and new electric components to produce a non-lethal tetherless NDG. The NDG is "tetherless" in the sense that there is no need for a conductive path back to the gun.

The NDG uses a projectile that is essentially a liquid-based capacitor. The projectile is charged prior to being fired and carries the charge in flight. Thus, rather than being charged after striking the target via connecting wires or an air path, the projectile is charged prior to being fired and carries the charge in flight. It is expected that the NDG can have ballistic characteristics similar to those of a shotgun or compressed air paintball gun, with a delivery range of at least 60 meters.

DETAILED DESCRIPTION OF THE INVENTION

Figure 1:
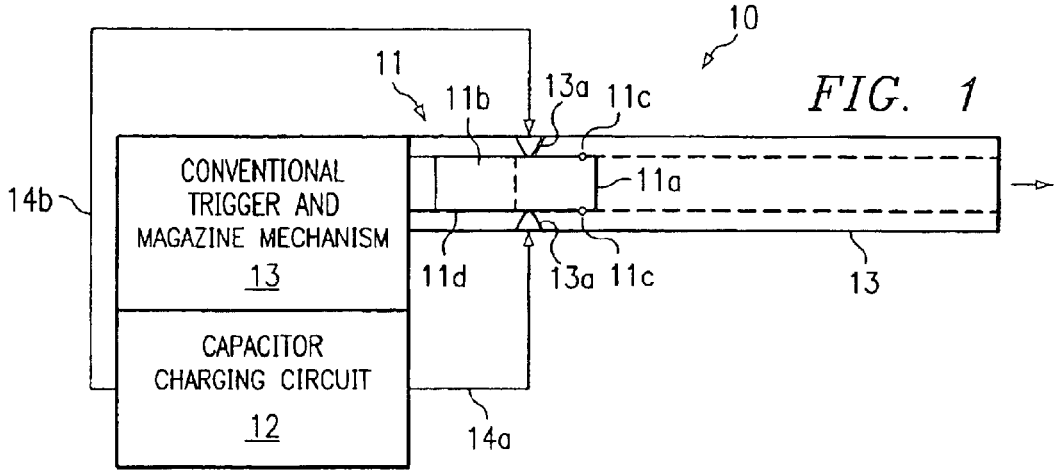
FIG. 1 is a schematic side view of a neuromuscular disrupter gun and projectile in accordance with the invention.

FIG. 1 is a schematic side view of a neuromuscular disrupter gun (NDG) 10 in accordance with the invention. As explained below, NDG 10 uses a liquid-filled projectile 11*a* that receives a high voltage charge before being fired and that discharges upon impact. Projectile 11*a* is essentially a capacitor, and in various embodiments, the liquid may be either the conductive or dielectric element(s) of the capacitor.

The projectile 11*a* holds the charge while in flight and discharges on impact. The charge is delivered as a single pulse, and the discharge has sufficient electrical energy to disrupt neuromuscular activity. At the same time, projectile 11*a* has insufficient kinetic energy on impact to ensure that it is non lethal. To this end, the projectile 11*a* is primarily comprised of liquid and flexible material. On impact, the projectile 11*a* delivers its electrical discharge and kinetic energy. The projectile 11*a* can be designed so that the kinetic aspect of impact produces at most, skin damage or blunt trauma. For example, the liquid portion of projectile 11*a* may be housed in a material that harmlessly breaks on the target's surface without penetration.

In the embodiment of FIG. 1, projectile 11*a* is contained within a shell 11, which also houses a propellant 11*b*. A conventional propellant mechanism may be used, such as a gunpowder type propellant like that used for a shotgun or such as a compressed gas propellant. A typical diameter of shell 11 is 20 millimeters.

In the embodiment of FIG. 1, shell 11 also houses a pair of short contact wires 11*c*. These contact wires 11*c* unfurl and contact the target upon impact of the projectile 11*a*, thereby providing contact points for discharge of the charge carried by projectile 11*a*.

For deployment of shell 11 a conventional trigger and magazine mechanism 13 may be used. The barrel 13 of NDG 10 is dielectrically lined to prevent discharge of the projectile 11*a* during firing.

Figure 1A:
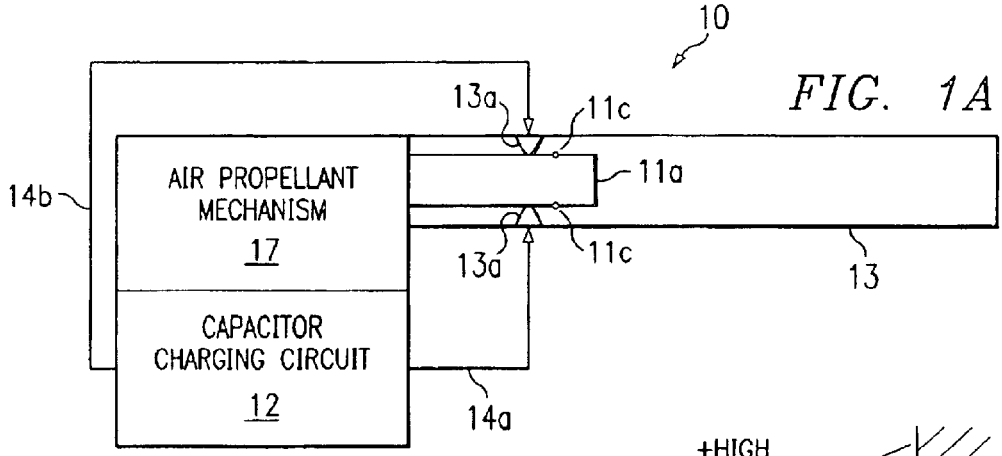
FIG. 1A illustrates an embodiment of the neuromuscular disrupter gun particularly designed to use compressed gas to fire the projectile.

The embodiment of FIG. 1A is specifically directed to using compressed gas to propel projectile 11*a* from barrel 13 of NDG 10. This embodiment of NDG 10 may be implemented with or without use of a shell. A mechanism similar to that used for paintball guns may be used. Such mechanisms can be powered by carbon dioxide, nitrogen, or compressed air. A suitable system has a refillable tank 17 that enables the NDG 10 to be fired numerous times before needing a refill. For example, a 12 gram carbon dioxide canister could be suitable for about 20–30 shots.

Referring to both FIGS. 1 and 1A, a capacitor charging circuit 12 is used to charge projectile 11*a*. Charging circuit 12 is essentially a battery-powered inverter, which is capable of charging the projectile 11*a* within a typical range between 10,000 to 50,000 volts DC. Leads 14*a* and 14*b* extend from circuit 12 into barrel 13 to charge projectile 11*a* prior to firing. Ring-type contacts 13*a* may be used to provide contact between leads 14*a* and 14*b* inside barrel 13 and appropriate points within projectile 11*a* when projectile 11*a* is in place for firing.

The power and range of NDG 10 are related to the force of impact. To retain non lethal characteristics and to further safety considerations, tradeoffs on power and range may be made. For example, although a 300 fps speed is typical of a paintball type gun, that speed may be increased in the case of NDG 10 without sacrificing its non-lethal characteristics. Where close range impact is expected, techniques may be incorporated into NDG 10 to automatically measure distance to the target and adjust the velocity of the shot in response. For example, where NDG 10 is fired with compressed gas, the gas pressure could be controlled. A laser range finder could be used to detect and measure the distance to the target. An additional feature of NDG 10 that ensures non lethality is that that projectile 11*a* is comprised of materials that minimize the force of impact.

Although illustrated as a stand-alone device, NDG 10 could also be used as attachable equipment to conventional ballistic weapons, such as M-16 or M-4 weapons.

Figure 1B:
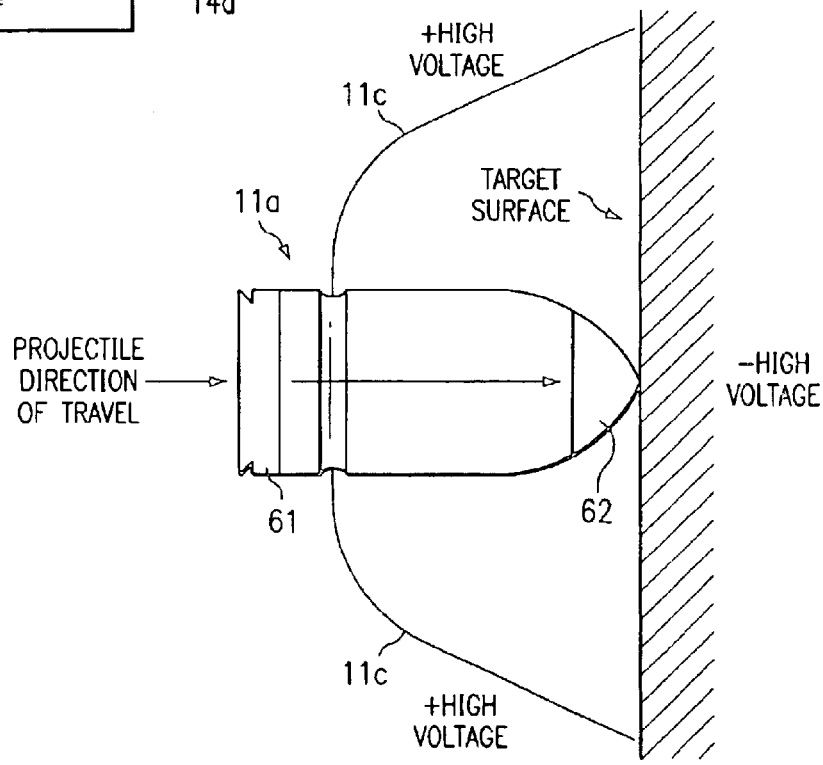
FIG. 1B illustrates the projectile's contact wires after impact on a target.

FIG. 1B illustrates the contact wires 11*c*, which unfurl during flight of projectile 11*a*, and contact the target on impact. To effectively deliver a discharge to a human target, the discharge is preferably between two points on the body, approximately six inches apart. This can be accomplished by using projectile spin to unfurl wires 11*c* on either side of projectile 11*a*. An example of a suitable material for wires 11*c* is #32 AWG wire. Each wire provides either the positive or negative contact with the target. Skin contact is not necessary. As with a conventional NDG, the high voltage will arc a considerable distance without contact.

A single contact wire embodiment of NDG 10 is also possible. In this embodiment, a single contact wire 11*c* is attached to projectile 11*a* rather than a pair of contact wires. Upon impact, the nose of projectile 11*a* provides one contact point and the wire 11*c* provides the other. A common feature of the embodiments that use a contact wire is that the wires are used to radially disperse contact points rather then to connect the projectile to the gun. A "spray" embodiment, which uses no contact wires, is described below.

Figure 2:
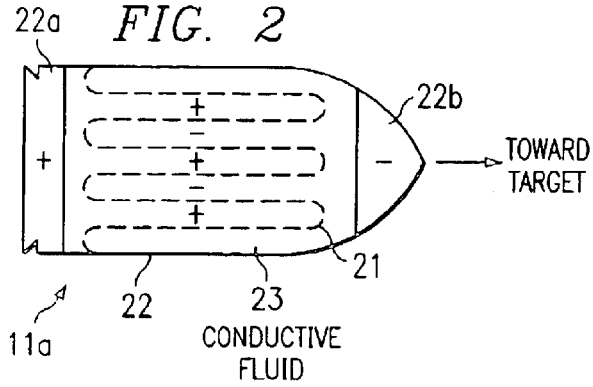
FIGS. 2 and 3 are side and end cross sectional views, respectively, of one embodiment of the projectile of FIGS. 1 and 1A.
Figure 3:
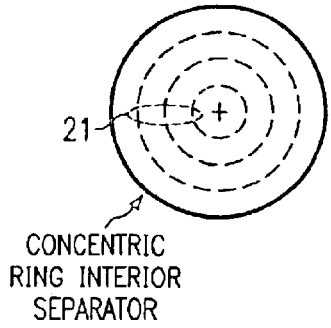

FIGS. 2 and 3 are a side cross sectional view and an end cross sectional view, respectively, of one embodiment of projectile 11*a*. Essentially, projectile 11*a* is a liquid-filled capsule having means for applying a charge such that the projectile forms a capacitor. There are a vast many alternative capacitor designs possible for implementing projectile 11*a*, such as spherical, spiral, parallel, and stacked plate designs.

In the example of FIGS. 2 and 3, the liquid within projectile 11*a* is conductive to form the capacitor plates and the separator 21 is dielectric. Separator 21 extends from one side of projectile 11*a* to the other so as to divide the liquid within projectile 11*a* into two parts. A rear part of the liquid receives a positive voltage and the front part of the liquid receives a negative voltage. Thus, the capacitor formed within projectile 11*a* is charged by applying voltages to the liquid at front end and back end of the projectile.

In the example of FIGS. 2 and 3, separator 21 has a folded design, which maximizes the surface area of the dielectric and thereby maximizes the capacitance of the projectile 11*a*. As illustrated in FIG. 3, the folds form concentric rings within the housing 22. However, in the simplest embodiment, separator 21 could be simply a straight wall from one side of inner surface of housing 22 to the other side, separating the interior of projectile 11*a* into two parts. An example of a suitable material for separator 21 is a flexible material, such as polyethylene.

The outer housing 22 of projectile 11*a*, which may be of any material suitable for containing liquid, may be designed to minimize impact force on the target. This may be accomplished by using a material that fragments, that is flexible, soft, or non rigid. An example of a suitable material for housing 22 is polyethylene. A sabot may be used to maintain the integrity of projectile 11*a* until it reaches muzzle velocity. The overall shape of housing 22 is typically bullet-shaped but may be round or any other shape.

End caps 22*a* and 22*b* are used to provide an electrical connection between leads 14*a* and 14*b* and the conductive liquid 23. A suitable material for end caps 22*a* and 22*b* is a conductive material, such as metal foil. As explained below in connection with FIG. 6, end cap 22*a* may be designed to open upon impact, so as to emit liquid 23 as a spray, eliminating the need for contact wires. Or, as in FIGS. 1 and 1A, contact wires 11*c* may be attached to projectile 11*a*.

Figure 4:
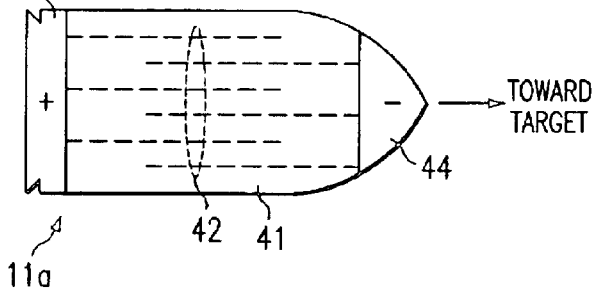
FIGS. 4 and 5 are side and end cross sectional views, respectively, of a second embodiment of the projectile of FIGS. 1 and 1A.
Figure 5:
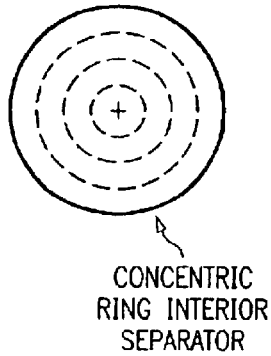

FIGS. 4 and 5 illustrate an alternative design of projectile 11*a*. FIG. 4 is a side cross sectional view and FIG. 5 is an end cross sectional view. In this design, projectile 11*a* is filled with a non-conductive liquid, which is the capacitor dielectric. An example of a suitable liquid is dionized water.

The capacitor plates 42 are made from a conductive material, such as metal foil. In a manner analogous to the embodiment of FIGS. 2 and 3, the conductive capacitor elements (here plates 42) extend into the interior of housing 22 as concentric rings to maximize the dielectric surface area. One set of ring shaped plates 42 extends from one end of housing 22, which is positively charged. Another set of ring shaped plates 42 extends from the opposing end of housing 22, which is negatively charged. Equivalently, plates 42 may extend from opposing sides of housing 22 rather than its ends. In general, the capacitor within housing 22 is formed be any array of two or more plates 42. Plates 42 typically extend from the inner surface of housing 22 so that they may be charged by means of contact points on the outer surface of the housing 22.

Like the projectile 11*a* of FIGS. 2 and 3, the projectile 11*a* of FIGS. 4 and 5 may be designed for soft impact on the target. Thus, the shell and separator plates 42 may be made from a flexible material.

In the example of FIGS. 4 and 5, rear end cap 43 and front cap 44 are made from a conductive material. Positive and negative capacitor plates 42 extend from rear end cap 43 and front cap 44, respectively. The conductivity of caps 43 and 44 permits a charging connection to be easily made between the outer surface of projectile 11*a* and the inside of barrel 13 of NDG 10. In other configurations, caps 43 and 44 need not be conductive. To further the non lethal characteristics of NDG 10, caps 43 and 44 may be made from a soft or pliable material, such as metal foil.

For the non-conductive liquid embodiment of FIGS. 4 and 5, a water-based gel might be used to fill projectile 11*a*. A gel of this type has a relative dielectric constant of approximately 80, and can be used to provide a low-loss liquid capacitor. With such a dielectric, it is possible to produce a 400 picofarad spiral-wound parallel plate capacitor within a volume of about 2 cubic centimeters. Capacitor energy, E, is expressed as:

$$E=1/2(CV)^2,$$

thus a 400 picofarad capacitor charged to 50,000 volts DC could produce a single discharge of 0.5 joules into the target. Although water has a high dielectric constant, its conductivity is not particularly high, being about $10^6$ ohms-cm, as compared to other capacitor dielectrics. An additional dielectric parallel to water may be added to reduce conductivity and increase the discharge time. Depending on the deployment velocity, the loss of charge during the time of flight to the target may vary.

Projectile 11*a* is further designed to withstand dielectric stress on the liquid and other dielectric material from which projectile 11*a* is comprised. During rapid charging and discharging, voltage stress will be greater on the material having the lower dielectric constant. In the embodiment of FIGS. 4 and 5, this potential problem can be dealt with by ensuring appropriate thicknesses of the water and an insulating material around plates 42. For example, if the dielectric constant for water is 80 and the dielectric constant for the insulating material (an ion barrier) is 2, then a water layer of 80 mils would be matched with an insulating layer of 2 mils. This would ensure equivalency of the voltage distributions. Alternatively, non equal distributions could be used so long as the breakdown strength of the insulating layer is not exceeded. A further alternative would be to make one or more of the conductive capacitor plates 42 from a conductive liquid such as salt water. The salt water would be insulated from the other metal foil plates 42 with a conventional high-voltage dielectric such as polyethylene or diala oil.

Figure 6:
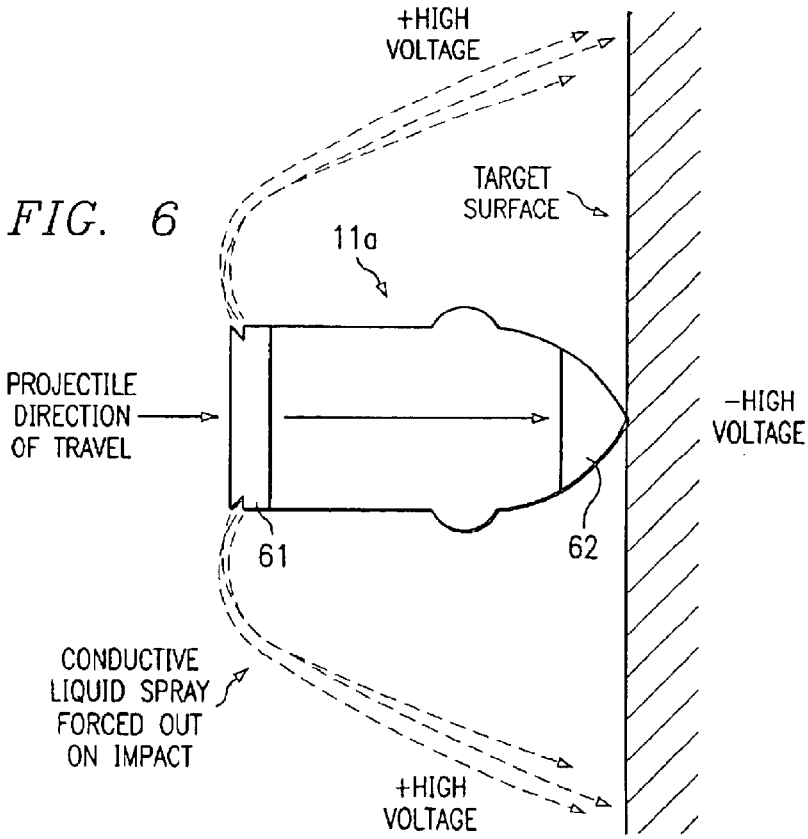
FIG. 6 illustrates an embodiment of the projectile that uses a spray for contact with the target rather than contact wires.

FIG. 6 illustrates how projectile 11*a* may be implemented without the use of contact wires 11*c*. In this embodiment, projectile 11*a* is designed to spray its conductor fluid on impact. To this end, the force of impact causes base 61 to open at its sides and emit spray. The spray would provide one contact and the conductive nose 62 of the projectile would provide the other. Spray patterns can be designed to provide an optimum distance between contact points for discharge of the capacitor. The liquid sprayed from projectile 11*a* may be the same conductive liquid as used to form the capacitor or may come from a separate source within the projectile.

Other Embodiments

Although the present invention has been described in detail, it should be understood that various changes, substitutions, and alterations can be made hereto without departing from the spirit and scope of the invention as defined by the appended claims.

What is claimed is:

1. A projectile for use with a wireless neuromuscular disrupter gun for delivery of an electrical charge to a target, comprising:

an outer housing suitable for containing liquid;

a capacitor contained within the housing, wherein the conductive liquid provides the capacitor dielectric, which separates the capacitor plates; and contacts for delivering an electrical charge to the capacitor while the projectile is inside the gun prior to firing of the gun, such that no wires are required to charge the capacitor after the projectile leaves the gun.

2. The projectile of claim 1, wherein the capacitor plates form at least one concentric ring within the outer housing.

3. The projectile of claim 1, wherein the liquid is dionized water.

4. The projectile of claim 1, further comprising at least one contact wire attached to the outer surface of the projectile and operable to unfurl during flight of the projectile.

5. The projectile of claim 1, wherein the contacts are conductive ends of the housing.

6. The projectile of claim 1, wherein the capacitor plates are formed from material folded within the housing.

7. The projectile of claim 1, wherein the capacitor plates extend from the inner surface of the housing.

8. The projectile of claim 1, wherein the capacitor plates separate the interior of the housing into at least two portions.

9. The projectile of claim 1, wherein the housing is made from a material that deforms upon impact.

10. The projectile of claim 1, wherein the liquid is a water-based gel.

11. The projectile of claim 1, wherein the liquid has a dielectric constant of at least 80.

12. The projectile of claim 1, wherein the capacitor has a capacitance value of at least 400 picofarads.

13. The projectile of claim 1, wherein the capacitor plates are insulated from the liquid with an insulating material.

14. The projectile of claim 13 wherein the insulating material has a dielectric constant lower than that of the liquid.

15. The projectile of claim 1, wherein at least one capacitor plate is made from a conductive liquid.

16. The projectile of claim 1, wherein the housing breaks apart upon impact.

17. The projectile of claim 1, wherein the projectile is bullet shaped.

18. A method of using a neuromuscular disrupter gun for delivery of an electrical charge to a target, comprising the steps of:

forming a capacitor within a projectile housing, wherein liquid within the housing provides the capacitor dielectric, which separates the capacitor plates;

electrically charging the capacitor while the projectile is in the gun; and firing the charged projectile from the gun.

19. The method of claim 18, further comprising the step of attaching at least one contact wire to the outer surface of the housing, such that the contact wire travels with the projectile and is operable to unfurl during flight of the projectile.

20. The method of claim 18, wherein the firing step is performed using gunpowder.

21. The method of claim 18, wherein the firing step is performed using compressed gas.

22. The method of claim 18, wherein the capacitor plates form at least one concentric ring within the outer housing.

23. The method of claim 18, wherein the liquid is dionized water.

24. The method of claim 18, further comprising at least one contact wire attached to the outer surface of the projectile and operable to unfurl during flight of the projectile.

25. The method of claim 18, wherein the capacitor plates are formed from material folded within the housing.

26. The method of claim 18, wherein the capacitor plates extend from the inner surface of the housing.

27. The method of claim 18, wherein the housing is made from a material that deforms upon impact.

28. The method of claim 18, wherein the liquid is a water-based gel.

29. The method of claim 18, wherein the liquid has a dielectric constant of at least 80.

30. The method of claim 18, wherein the capacitor has a capacitance value of at least 400 picofarads.

31. The method of claim 18, wherein at least one capacitor plate is made from a conductive liquid.

32. The method of claim 18, wherein the housing breaks apart upon impact.

* * * * *